US007578696B2

(12) United States Patent
Yuan

(10) Patent No.: US 7,578,696 B2
(45) Date of Patent: Aug. 25, 2009

(54) ELECTRICAL CONNECTOR WITH COVER CONFIGURED FOR HEAT DISSIPATION

(75) Inventor: Wei Yuan, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/214,966

(22) Filed: Jun. 23, 2008

(65) Prior Publication Data

US 2008/0318464 A1 Dec. 25, 2008

(30) Foreign Application Priority Data

Jun. 21, 2007 (CN) ..... 2007 2 0038820

(51) Int. Cl.
*H01R 13/00* (2006.01)

(52) U.S. Cl. ..... 439/485; 439/607; 439/567; 439/541.5

(58) Field of Classification Search ..... 439/485, 439/487, 607, 567, 541.5
See application file for complete search history.

(56) References Cited

U.S. PATENT DOCUMENTS

| | | | | |
|---|---|---|---|---|
| 5,167,531 | A * | 12/1992 | Broschard et al. | 439/541.5 |
| 5,658,155 | A * | 8/1997 | McFarlane et al. | 439/79 |
| 5,947,769 | A * | 9/1999 | Leonard et al. | 439/607 |
| 6,494,724 | B1 * | 12/2002 | Bixler et al. | 439/79 |
| 6,776,629 | B2 | 8/2004 | Shuey | |
| 6,890,221 | B2 * | 5/2005 | Wagner | 439/855 |
| 7,044,777 | B1 * | 5/2006 | Daly et al. | 439/540.1 |

* cited by examiner

*Primary Examiner*—Truc T Nguyen
(74) *Attorney, Agent, or Firm*—Wei Te Chung

(57) ABSTRACT

An electrical connector assembly includes an insulative housing (10) including a forwardly protruding mating port in a suspension manner. A plurality of contacts (30) is disposed in the housing each defining an L-shaped base portion (302) including a horizontal section and a vertical section. A cover (20) is attached onto the insulative housing and includes a vertical plate (201) for covering the vertical section of each contact (30), the vertical plate (201) defining a plurality of through slots (211) for heat dissipation. This configuration of the cover has the capability of providing good heat dissipation for the electrical connector.

16 Claims, 3 Drawing Sheets

ELECTRICAL CONNECTOR WITH COVER CONFIGURED FOR HEAT DISSIPATION

BACKGROUND OF THE INVENTION

1. Field of the Invention

The present invention relates to the art of electrical connectors, and more particularly to an electrical connector including a cover configured for heat dissipation.

2. Description of the Related Art

In general, electrical connectors are designed to electrically connect two separated electronic components. With the trends of having a high-power capacity, the electrical connectors are required to having contacts capable of transmitting a high-power current, which needs to be equipped with a heat dissipation device to avoid the electrical connection failure resulted from the heat. Related connectors are found in U.S. Pat. Issue. No. 6,776,629 and US Pat. Pub. No. 20060014438. These connectors are provided with heat dissipation devices, which have no good capability of heat dissipation. That is because structures of the heat dissipation devices do not match with those of the electrical connectors.

SUMMARY OF THE INVENTION

An electrical connector assembly according to an embodiment of the present invention includes an insulative housing including a forwardly protruding mating port in a suspension manner and defining therein an array of cavities each essentially having a square cross-section for receiving a corresponding silo part of a complementary plug connector. A plurality of contacts is disposed in the housing each defining an L-shaped base portion with a mating portion positioned at a front end of the base portion and disposed in the corresponding cavity, and with a mounting portion positioned at a bottom end of the base portion and located around a mounting face of the housing, the L-shaped base portion including a horizontal section and a vertical section. A cover is attached onto the insulative housing and includes a vertical plate for covering the vertical section of each contact, the vertical plate defining a plurality of through slots for heat dissipation. This configuration of the cover has the capability of providing good heat dissipation for the electrical connector.

Other features and advantages of the present invention will become more apparent to those skilled in the art upon examination of the following drawings and detailed description of preferred embodiments, in which:

DETAILED DESCRIPTION OF PREFERRED EMBODIMENT

Figure 1:
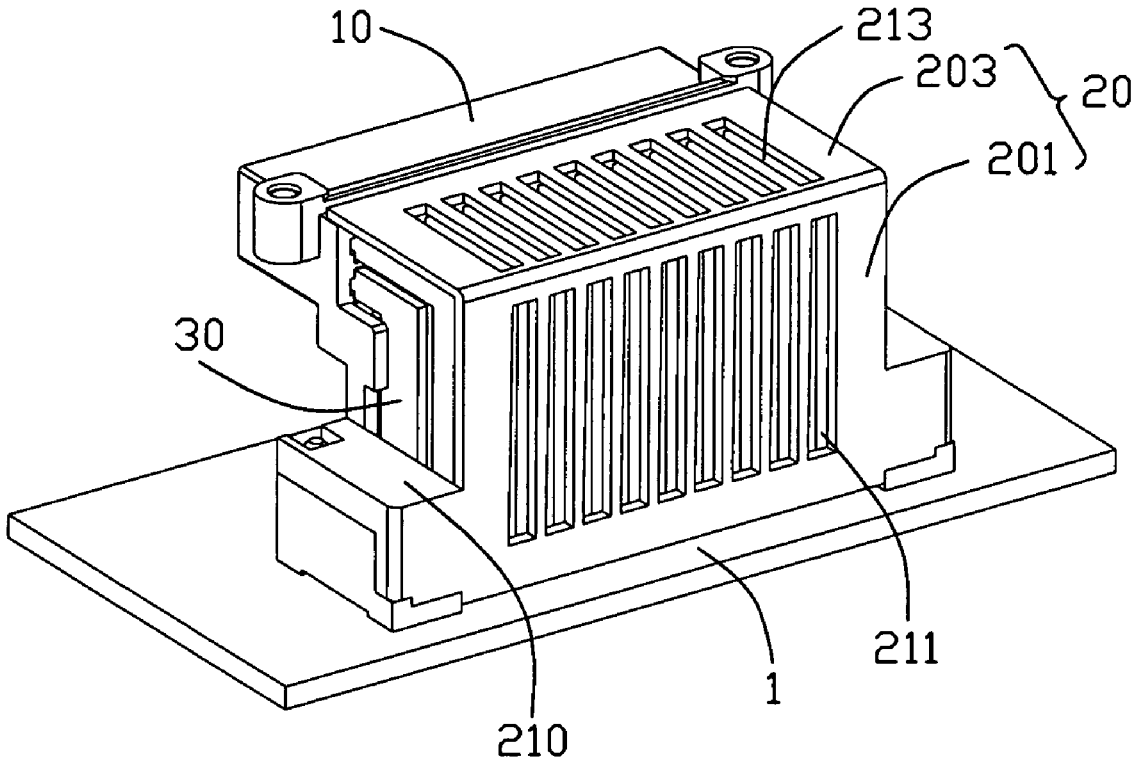
FIG. 1 is an assembled, perspective view of an electrical connector assembly according to an embodiment of the present invention.
Figure 2:
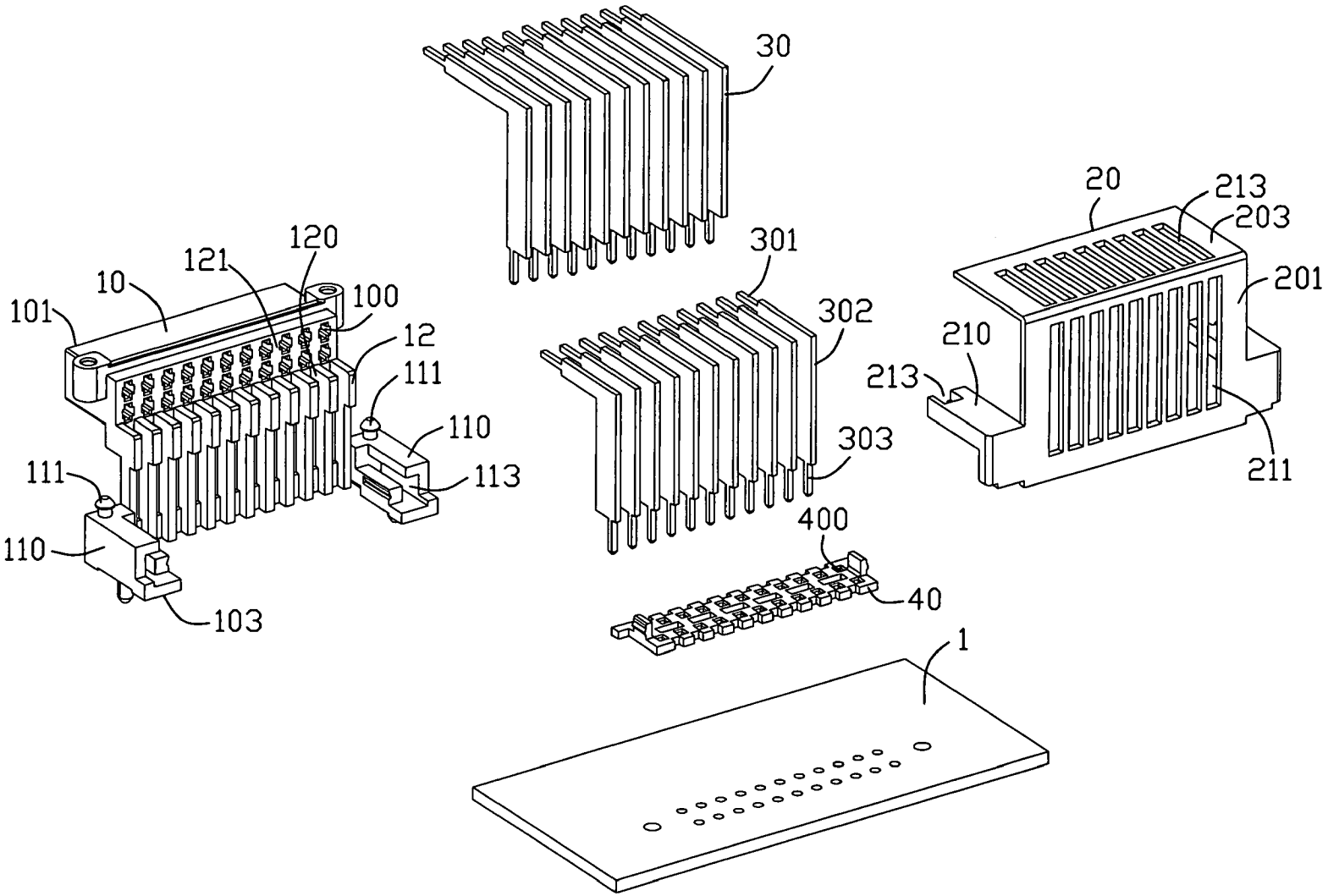
FIG. 2 is an exploded, perspective view of the electrical connector assembly of FIG. 1.
Figure 3:
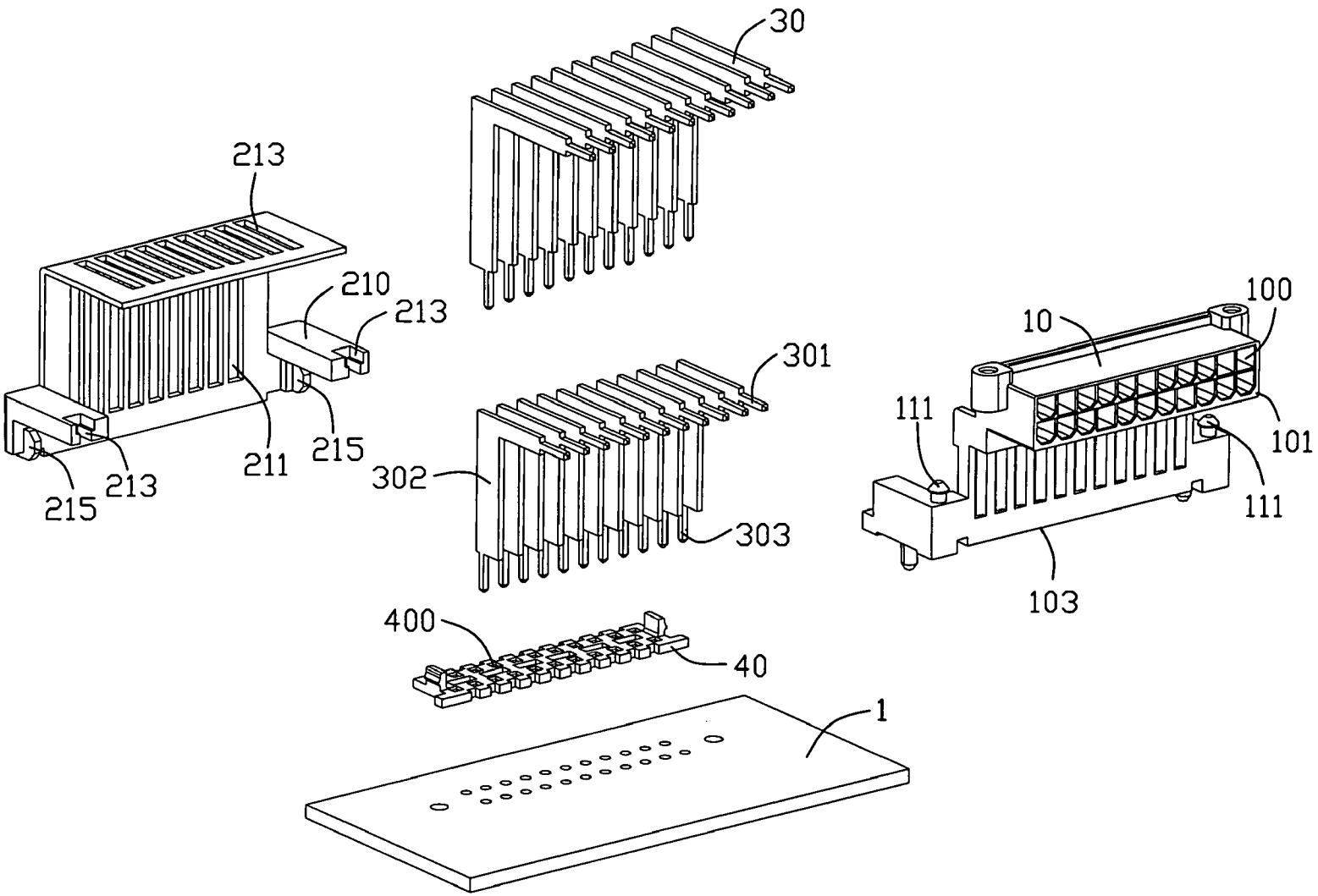
FIG. 3 is another exploded, perspective view of the electrical connector assembly of FIG. 1, viewed from another aspect.

Referring to FIGS. 1 to 3, an electrical connector assembly mounted onto a printed circuit board 1 according to an embodiment of the present invention is shown to have an insulative housing 10 including a forwardly protruding mating port in suspension manner and defining therein an array of cavities 100 each essentially having a square cross-section for receiving a corresponding silo part of a complementary plug connector (not shown). A plurality of ribs 12 is formed on a rear face 121 of the insulative housing 10 in alignment with the corresponding cavities 10, respectively, so as to form a plurality of channels 120 each between every adjacent two ribs 12. The insulative housing 10 further includes a pair of abutments 110 located at opposite sides of a bottom section of the housing 10, which is located proximate to a mounting face 103 of the housing 10. The abutments 110 are configured to engage with a pair of mounting boards 210 of a cover 20 so as to assemble the cover 20 onto the insulative housing 10, to be later described. A spacer 40 is assembled onto a bottom of the insulative housing 10 and defines a plurality of through holes 400 aligned with corresponding through slots 213 of a horizontal plate 203 of the cover 20, to be later described.

A plurality of contacts 30 is inserted into the cavities 100 in a direction from the rear face 121 to a front face 101 of the housing 10. Each of the contacts 30 has an L-shaped base portion 302 with a mating portion 301 positioned at a front end of the base portion 302 and disposed in the corresponding cavity 100, and with a mounting portion 303 positioned at a bottom end of the base portion 302 and located around the mounting face 103 of the housing 10. The L-shaped base portion 302 includes a horizontal section partly inserted into each of the cavities 100, and a vertical section disposed within the corresponding channel 120. Both the mating portion 301 and the mounting portion 303 have a similar size which is much smaller than that of the base portion 302 at least in either a width direction of the contact 30 or a thickness direction of the contact 30 which are perpendicular to each other. In this preferred embodiment, both the mating portion 301 and the mounting portion 303 has a size which is smaller than that of the base portion 302 in a width direction of the contact.

The cover 20 is assembled onto the insulative housing 10 for covering the L-shaped contacts 30, and includes a vertical plate 201 with a plurality of vertical through slots 211 aligned with the corresponding cavities 100 of the insulative housing 10, and the horizontal plate 203 with a plurality of horizontal through slots 213 aligned with the corresponding through holes 400 of the spacer 40, all of which are configured for heat dissipation. The vertical plate 201 is adapted for covering the vertical section of each contact 30, while the horizontal plate 203 is adapted for covering the horizontal section of each contact 30. As shown in FIG. 1, when the cover 20 is assembled onto the insulative housing 10, the outside contacts 30 are exposed outside of the cover 20 and the housing 10 for achieving a better heat dissipation. In addition, the cover 20 further includes a pair of L-shaped supporting member each having the horizontal mounting board 210 and a vertical board, with the horizontal mounting board 210 defining therein a groove 213 engagement with a nut 111 on each of the abutments 110, and with the vertical board having a rib 215 on an inside wall of the vertical board to be engageable with a slot 113 of each of the abutments 110, so as to assembled the cover 20 onto the insulative housing 10.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. An electrical connector assembly comprising:

an insulative housing including a forwardly protruding mating port in a suspension manner and defining therein an array of cavities each essentially having a square cross-section for receiving a corresponding silo part of a complementary plug connector;

a plurality of ribs formed on a rear face of the housing in alignment with the corresponding cavities, respectively, so as to form a plurality of channels each between every adjacent two ribs;

a plurality of contacts disposed in the housing each defining an L-shaped base portion with a mating portion positioned at a front end of the base portion and disposed in the corresponding cavity, and with a mounting portion positioned at a bottom end of the base portion and located around a mounting face of the housing, said L-shaped base portion including a horizontal section and a vertical section; and a cover attached onto the insulative housing and including a vertical plate for covering the vertical section of each contact, the vertical plate defining a plurality of through slots for heat dissipation;

wherein the cover further includes a horizontal plate for covering the horizontal section of each contact, the horizontal plate defining a plurality of through slots for heat dissipation;

wherein each of the through slots of the vertical plate are aligned with the corresponding channels;

wherein each of the through slots of the horizontal plate are aligned with the corresponding channels.

2. The electrical connector assembly of claim 1, further including a spacer attached onto a bottom of the insulative housing, the spacer defining a plurality of through holes aligned with the corresponding through slots of the horizontal plate.

3. The electrical connector assembly of claim 1, wherein both said mating portion and said mounting portion have a similar size which is much smaller than that of the base portion at least in either a width direction of the contact or a thickness direction of the contact which are perpendicular to each other.

4. The electrical connector assembly of claim 1, wherein the insulative housing includes a pair of abutments locatable at opposite sides of a bottom region, which is located proximate to the mounting face of the insulative housing, the cover including a pair of mounting boards assembled onto the abutments of the insulative housing.

5. An electrical connector assembly comprising:

an insulative housing including a mating port with therein an array of cavities for receiving a corresponding silo part of a complementary plug connector;

a plurality of ribs formed on a rear face of the housing in alignment with the corresponding cavities, respectively, so as to form a plurality of channels each between every adjacent two ribs;

a plurality of contacts disposed in the housing, each of the contacts being of an L shape and defining a horizontal section partly inserted into each of the cavities and a vertical section disposed within the corresponding channel; and a cover assembled onto the insulative housing for covering the L-shaped contacts, the cover including a horizontal plate and a vertical plate each defining a plurality of through slots for heat dissipation;

wherein the cover further includes a horizontal plate for covering the horizontal section of each contact, the horizontal plate defining a plurality of through slots for heat dissipation;

wherein each of the through slots of the vertical plate are aligned with the corresponding channels;

wherein each of the through slots of the horizontal plate are aligned with the corresponding channels.

6. The electrical connector assembly of claim 5, wherein the through slots of the vertical plate are aligned with the corresponding cavities.

7. The electrical connector assembly of claim 5, further including a spacer attached onto a bottom of the insulative housing, the spacer defining a plurality of through holes aligned with the corresponding through slots of the horizontal plate.

8. The electrical connector assembly of claim 5, wherein the insulative housing includes a pair of abutments locatable at opposite sides of a bottom region, which is located proximate to the mounting face of the insulative housing, the cover including a pair of mounting boards assembled onto the abutments of the insulative housing.

9. The electrical connector assembly of claim 5, wherein both said mating portion and said mounting portion have a similar size which is much smaller than that of the base portion at least in either a width direction of the contact or a thickness direction of the contact which are perpendicular to each other.

10. An electrical connector comprising:

an insulative housing defining a lying Z-like configuration, in a side view, including an upper horizontal bar, a lower horizontal bar and an upstanding bar therebetween;

the upper horizontal bar defining therein an array of cavities a plurality of ribs formed on a rear face of the insulative housing in alignment with the corresponding cavities, respectively, so as to form a plurality of channels each between every adjacent two ribs;

a plurality of upside-down L-shaped contacts disposed in the cavities;

a cover defining a lying U-like configuration, in the side view, including an upper horizontal plate, a lower horizontal plate and an upstanding plate therebetween; and the cover assembled to the housing under a condition that the lower horizontal bar and the lower horizontal plate abut against each other;

wherein at least one of said horizontal upper plate and said upstanding plate defines a plurality of through slots to communicate the contacts with an exterior for heat dissipation wherein each of the through slots of the horizontal upper plate are aligned with the corresponding channels;

wherein each of the through slots of the upstanding plate are aligned with the corresponding channels.

11. The electrical connector as claimed in claim 10, wherein said horizontal plate and said horizontal bar define latching devices thereon, respectively, to be coupled to each other for allowing said cover to be assembled to housing forwardly in a horizontal direction.

12. The electrical connector as claimed in claim 11, wherein said latching device includes a nut on one of said horizontal bar and said horizontal plate, and a slot in the other of said horizontal bar and said horizontal plate.

13. The electrical connector as claimed in claim 11, wherein said latching device includes a rib on one of said horizontal bar and said horizontal plate, and a slot in the other of said horizontal bar and said horizontal plate.

14. The electrical connector as claimed in claim 11, further including a spacer having fastening structures attached to the housing for aligning the contacts.

15. The electrical connector as claimed in claim 14, wherein the latching devices are located above said fastening structures.

16. The electrical connector as claimed in claim 14, wherein said latching devices are located beside said fastening structures.

* * * * *